US011622591B2

(12) United States Patent
Reiter

(10) Patent No.: US 11,622,591 B2
(45) Date of Patent: Apr. 11, 2023

(54) AUXILIARY HEAD PROTECTION APPARATUS

(71) Applicant: Phil Reiter, Fridley, MN (US)

(72) Inventor: Phil Reiter, Fridley, MN (US)

( * ) Notice: Subject to any disclaimer, the term of this patent is extended or adjusted under 35 U.S.C. 154(b) by 0 days.

(21) Appl. No.: 17/840,065

(22) Filed: Jun. 14, 2022

(65) Prior Publication Data

US 2023/0011623 A1 Jan. 12, 2023

Related U.S. Application Data

(60) Provisional application No. 63/220,783, filed on Jul. 12, 2021.

(51) Int. Cl.
*A42B 3/18* (2006.01)

(52) U.S. Cl.
CPC ..... *A42B 3/18* (2013.01)

(58) Field of Classification Search
CPC .. A42B 3/18; A42B 3/20; A42B 3/003; A63B 71/10
See application file for complete search history.

(56) References Cited

U.S. PATENT DOCUMENTS

2012/0167289 A1* 7/2012 Kim ..... A63B 71/12 2/463
2014/0053324 A1* 2/2014 Jackson ..... A42B 3/0473 2/425
2020/0163400 A1* 5/2020 Salaam ..... A42B 3/0473

* cited by examiner

*Primary Examiner* — Katherine M Moran
*Assistant Examiner* — Erick I Lopez
(74) *Attorney, Agent, or Firm* — Dale J. Ream

(57) ABSTRACT

A head protection apparatus for covering a primary head protection device worn on the head of a sports player includes a base having a rim defining an open bottom for wear on the head of the player. A framework extends upwardly from points along the rim. The head protection apparatus includes a face shield coupled to upper ends of the framework and is pivotally movable between a closed configuration in which a lower edge bears against the rim thus blocking access to an interior area and an open configuration pivoted about an axis defined by the rear bar and which allows access to the interior area. The face shield includes a top wall having a crowned configuration so as to redirect otherwise direct impact forces. The head protection apparatus is worn by a sports player and for blocking impact to a primary player protection device worn by the player.

17 Claims, 9 Drawing Sheets

AUXILIARY HEAD PROTECTION APPARATUS

REFERENCE TO RELATED APPLICATIONS

This application claims the benefit of provisional patent application number 63/220,783 filed July 12, 2021 and titled Auxiliary Head Protection Apparatus, which is incorporated herein in its entirety.

BACKGROUND OF THE INVENTION

This invention relates generally to sports protective devices and, more particularly, to an auxiliary head protection apparatus for providing enhanced head protection to a wearer of a primary or traditional helmet.

Traditionally, each major sport is characterized by a certain degree of protective equipment, depending on the relative potential for injury while playing the respective sport. For instance, football players wear a helmet that includes cranial padding and a face guard so as to absorb or block the impact of tackling or being tackled by another player. Various other pads are common within or beneath the shirt and pants worn by a football player. Similarly, a lacrosse player may wear a less involved helmet but one that protects the head which may inadvertently get hit by another player's stick. Further, shin pads worn beneath a player's socks are well known.

Although presumably effective for their intended purposes, the existing protective devices, namely, a helmet in football, still fail to adequately protect a player's head. In recent years, medical diagnostics and professional knowledge has determined that long-time players of the game of football have a significantly higher occurrence of serious head trauma. Stated another way, the repeated impacts of a player's head against the helmets of other players and the ground result in physical damage to the player's brain.

Therefore, it would be desirable to have an auxiliary head protection apparatus that blocks or absorbs impact forces prior to said forces being encountered by a players' primary head protection device.

SUMMARY OF THE INVENTION

A head protection apparatus for covering a primary head protection device worn on the head of a sports player according to the present invention includes a base having a rim that defines an open bottom for wear on the head of the sports player. A framework extends upwardly from predetermined points along the rim. The head protection apparatus includes a face shield having a rear bar coupled to upper ends of the framework and is pivotally movable between a closed configuration in which a lower edge bears against the rim so as to block access to an interior area and an open configuration pivoted about an axis defined by the rear bar and which allows access to the interior area. The face shield includes a top wall having a crowned configuration so as to redirect otherwise direct impact forces. The head protection apparatus is worn by a sports player and for blocking impact to a primary player protection device.

Therefore, a general object of this invention is to provide an auxiliary head protection apparatus that covers and protects a wearer's primary head protection device.

Another object of this invention is to provide an auxiliary head protection apparatus, as aforesaid, that may be worn over the head and on the shoulders of a sports player and may be pivotally movable between open and closed configurations such that access is selectively obtained.

Still another object of this invention is to provide an auxiliary head protection apparatus, as aforesaid, that includes a crowned top wall configured to deflect or redirect direct impact forces.

Yet another object of this invention is to provide an auxiliary head protection apparatus, as aforesaid, that is easy and fast for a sports player to put on over his head and so as to prevent or decrease impact forces experienced by the primary head protection device.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
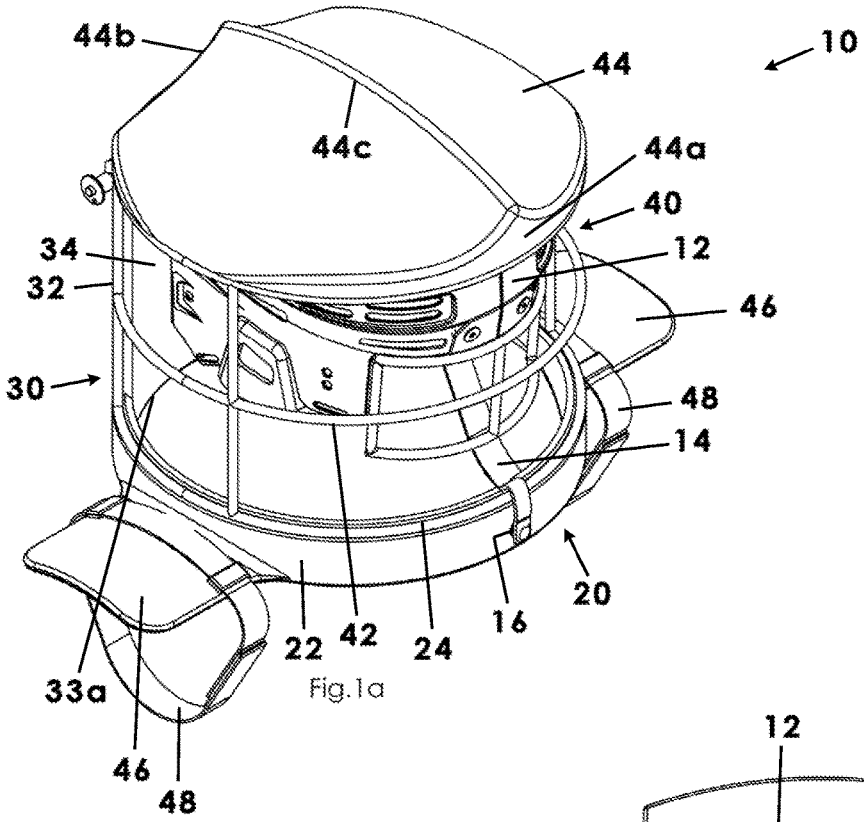
FIG. 1*a* is a perspective view of an auxiliary head protection apparatus according to a preferred embodiment of the present invention, illustrated with a lid portion in a closed configuration.
Figure 1B:
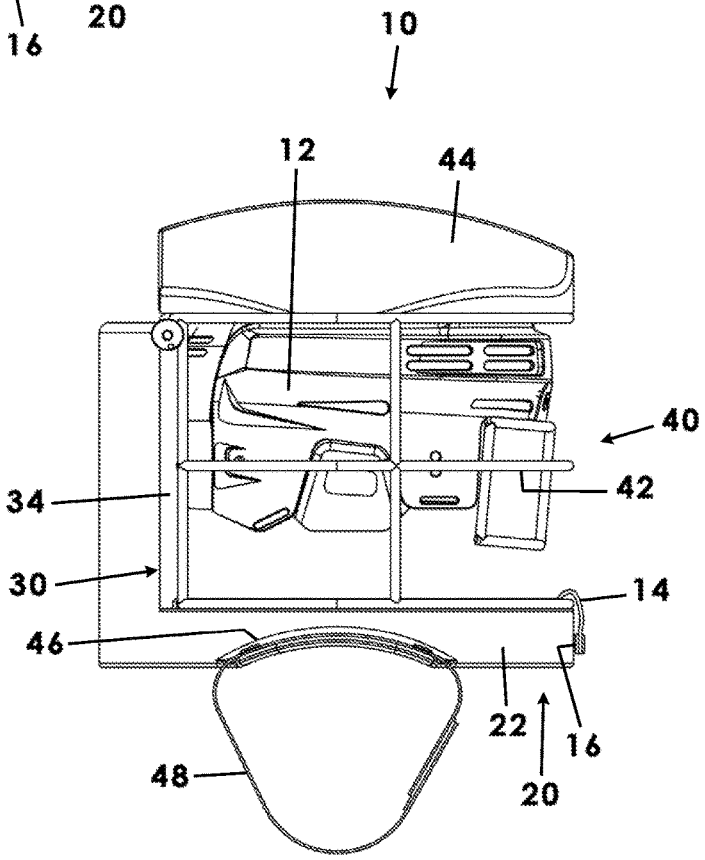
FIG. 1*b* is a side view of the auxiliary head protection apparatus as in FIG. 1*a;*
Figure 2A:
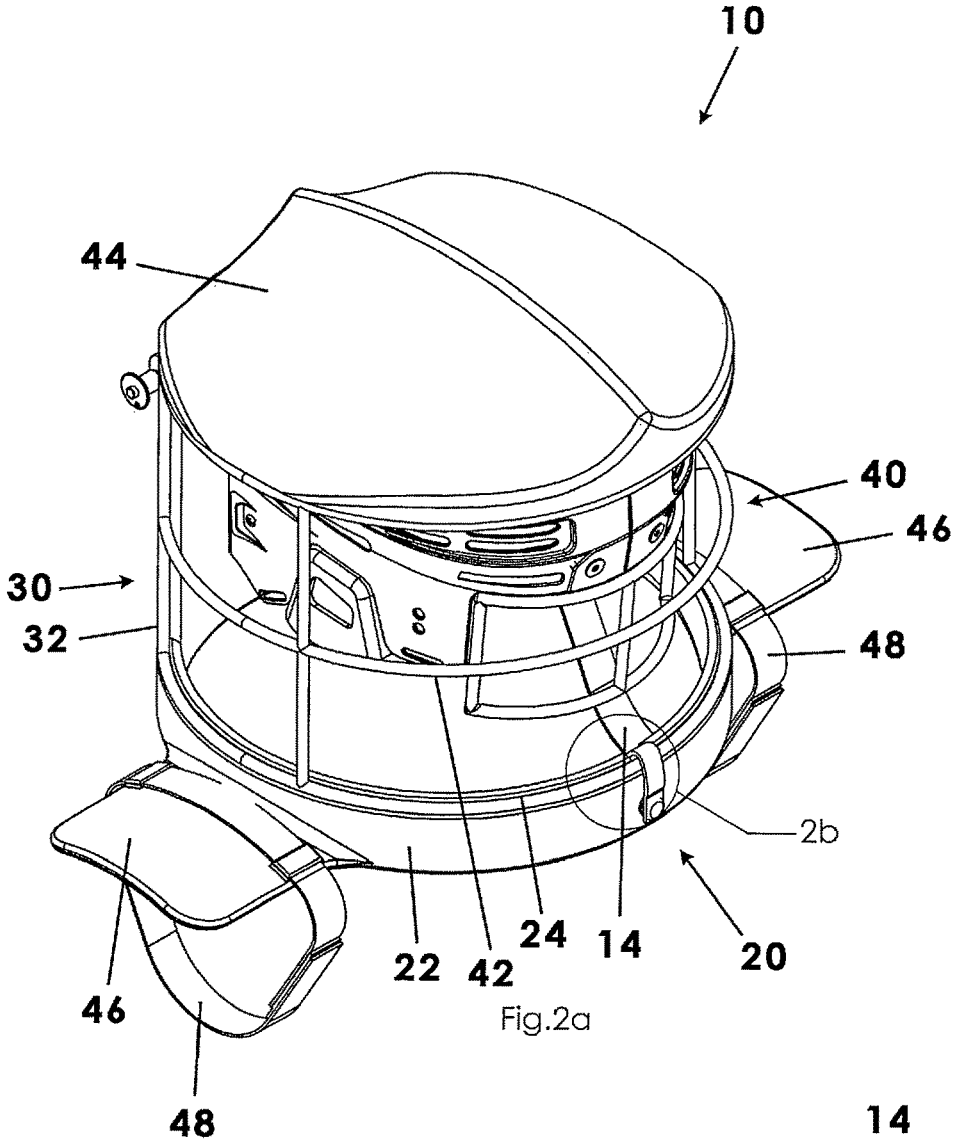
FIG. 2*a* is a perspective view of an auxiliary head protection apparatus according to a preferred embodiment of the present invention, illustrated with a lid portion in a closed configuration.
Figure 2B:
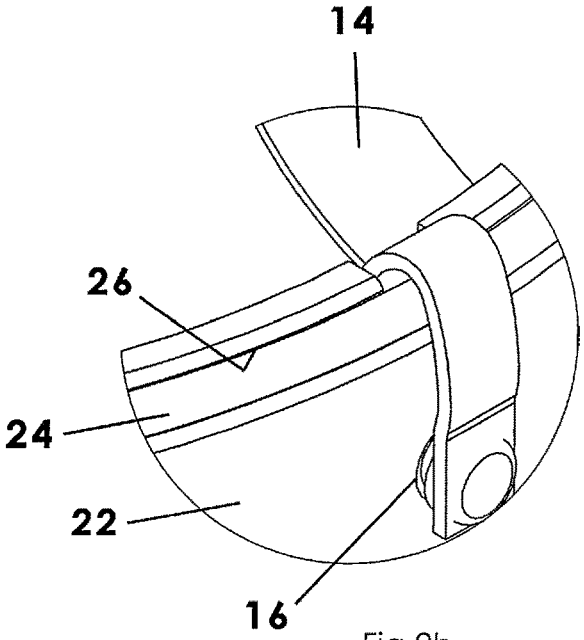
FIG. 2*b* is an isolated view on an enlarged scale taken from FIG. 1*a;*
Figure 3A:
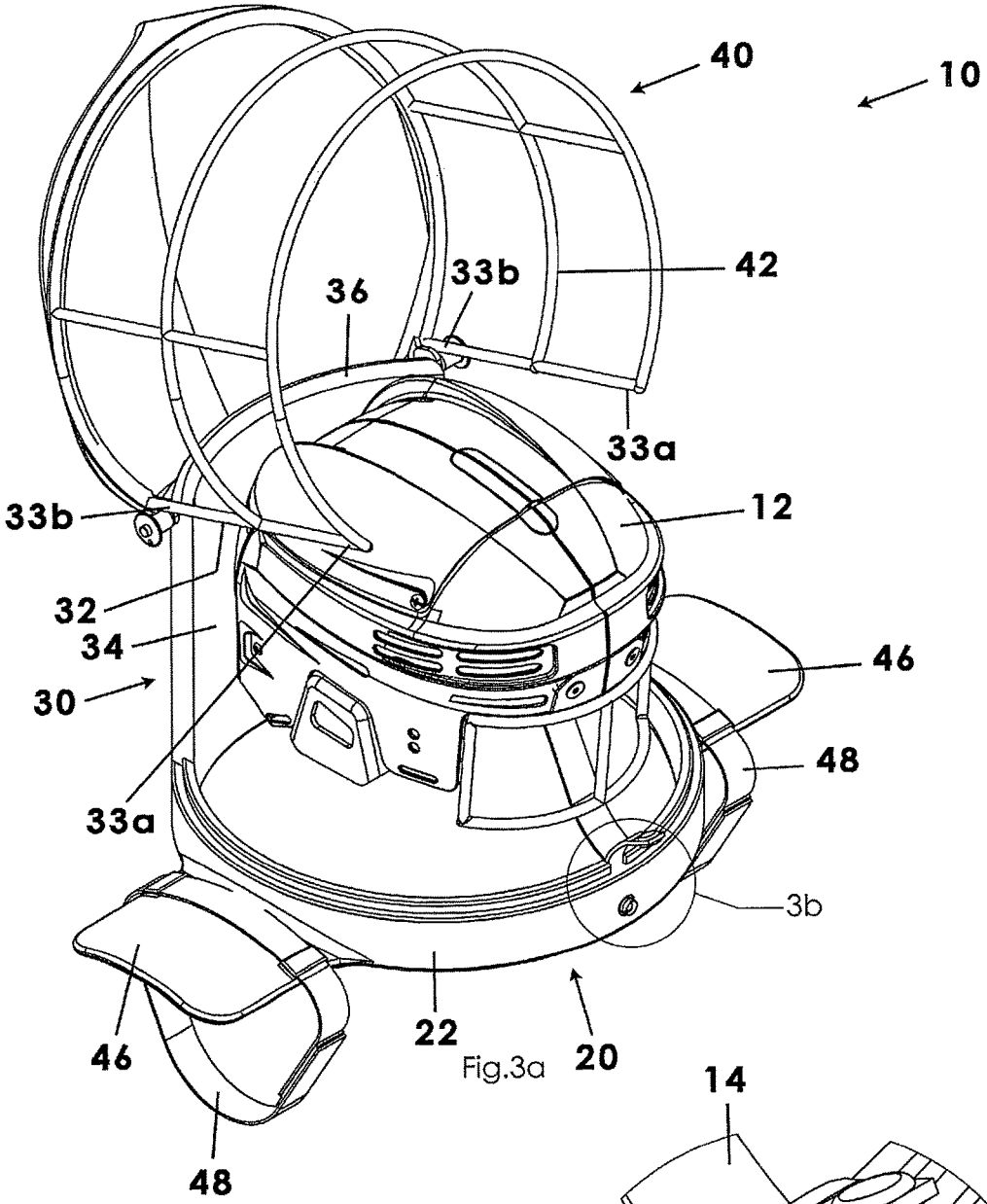
FIG. 3*a* is a perspective view of the auxiliary head protection apparatus as in FIG. 1*a*, illustrated with the lid portion in an open configuration.

An auxiliary head protection apparatus according to a preferred embodiment of the present invention will now be described with reference to FIG. 1*a* to 9*b* of the accompanying drawings. The auxiliary head protection apparatus 10 includes a base 20, a face shield 40 that is pivotally movable between closed and open configurations, and a top wall 44 having a crowned configuration capable of redirecting direct impact forces. The auxiliary head protection apparatus 10 defines an open bottom such that the apparatus may be worn over the head of a sport's player and positioned so as to completely cover a primary head protection device 12 (such as a football helmet) traditionally worn by the player. It is understood that the face shield 40 may include an array of bars 42 spaced apart from one another and capable of blocking incoming impact forces. In an embodiment, the array of bars 42 includes at least a pair of vertical bars spaced apart from one another and a pair of horizontal bars spaced apart from one another and extending between the pair of vertical bars (FIG. 3*a*). The array of bars 42 may be arranged similar to the bars of a traditional football helmet although preferably, they are further distributed over the face and eyes of a sport's player wearing the apparatus.

More particularly, the base 20 may include a rim 22 having an annular or ring-shaped configuration having inner and outer surfaces that are opposed to each other and which define an open bottom and an open interior area through which the apparatus 10 may be worn over the head of a sports player. The rim 22 may include an upper surface, also referred to as a shelf 24 that may define a groove 26 or raised shoulder configured to receive a bottom edge or bottom bar associated with the face shield 40 at a closed configuration as will be described later.

In an embodiment, auxiliary head protection apparatus 10 may include a framework 30 standing upwardly from the shelf 24 of the rim 22 of the base 20. In an embodiment, the framework 30 includes a rear wall 34 having a lower edge coupled to the rim 22 and extending upwardly to an upper edge 36, said rear wall 34 having an annular configuration and a solid construction so as to prevent encroachment of impact forces from a rear direction.

Further, the auxiliary head protection apparatus 10 includes a face shield 40 pivotally coupled to the rear wall 34 and is movable between closed and open configurations. More particularly, upper ends of the rearward support members of the framework 30 may be pivotally coupled to the upper edge 36 of the rear wall 34 of the rim 22. Further, the face shield 40 may include an array of bars 42 suitably configured and arranged so as to prevent or block impact forces (such as blocking or tackling by other sports players). The face shield 40 30 may include a upstanding support bars 32 from which horizontal bars of the array of bars 42 extend, each having a proximal end 33*a* coupled to the rim 22 and extending upwardly to a distal end 33*b* opposite the proximal end 33*a*.

In addition, the face shield 40 may include a top wall 44 (a.k.a. a lid) mounted atop an uppermost bar of the array of bars 42 of the face shield 40 such that the face shield 40 has a closed top. As shown in the drawings, the top wall 44 includes a front edge 44*a* and a rear edge 44*b* opposite the front edge and which define an imaginary longitudinal axis therebetween. As shown in the figures, the top wall 44 may be raised or crowned such that direct impact forces are urged or pushed outwardly and laterally. In other words, the top wall 44 is configured to form a ridge or ridged edge 44*c* that extends along the longitudinal axis and extends away from the top wall 44 so as to redirect impact forces.

In another aspect, the auxiliary head protection apparatus 10 may include a pair of mounting flanges 46 coupled to opposed outer surfaces of the base 20, respectively. Each mounting flange 46 extends outwardly or away from the base 20 and may have a slight curvature appropriate for nesting with the players shoulders or engaging football shoulder pads. A corresponding pair of straps 48 may be associated with the pair of mounting flanges 46, respectively, and may be used for coupling the mounting flanges to a user's shoulders or shoulder pads or other sports gear such as football shoulder pads.

Figure 3B:
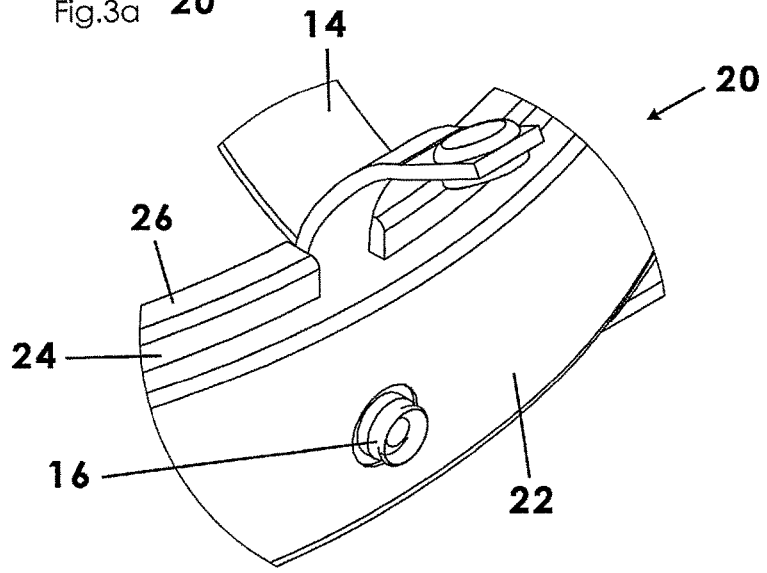
FIG. 3*b* is an isolated view on and in large-scale taken from FIG. 3*a;*
Figure 4A:
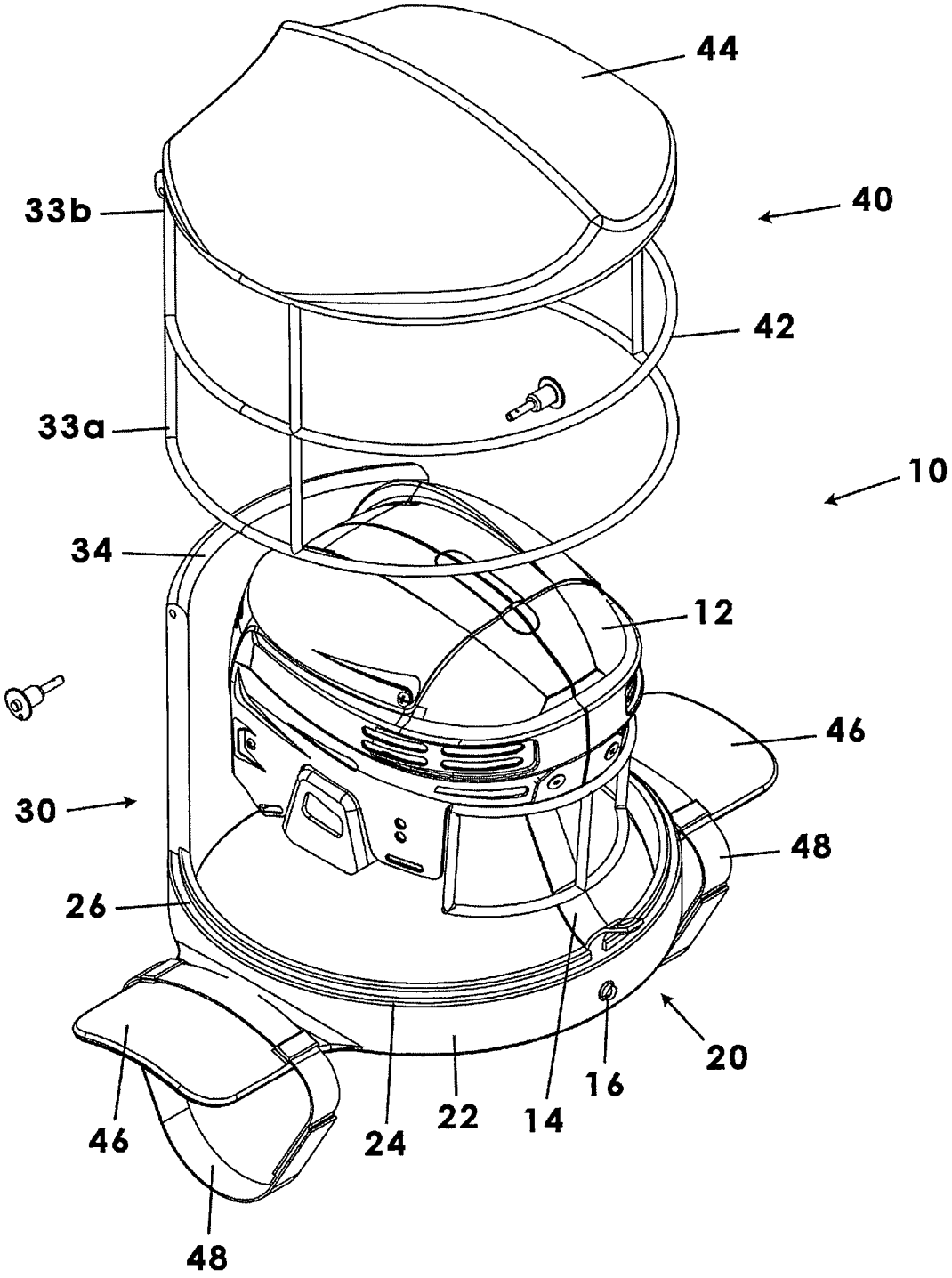
FIG. 4*a* is an exploded view of the auxiliary head protection apparatus as in FIG. 1*a;*
Figure 5A:
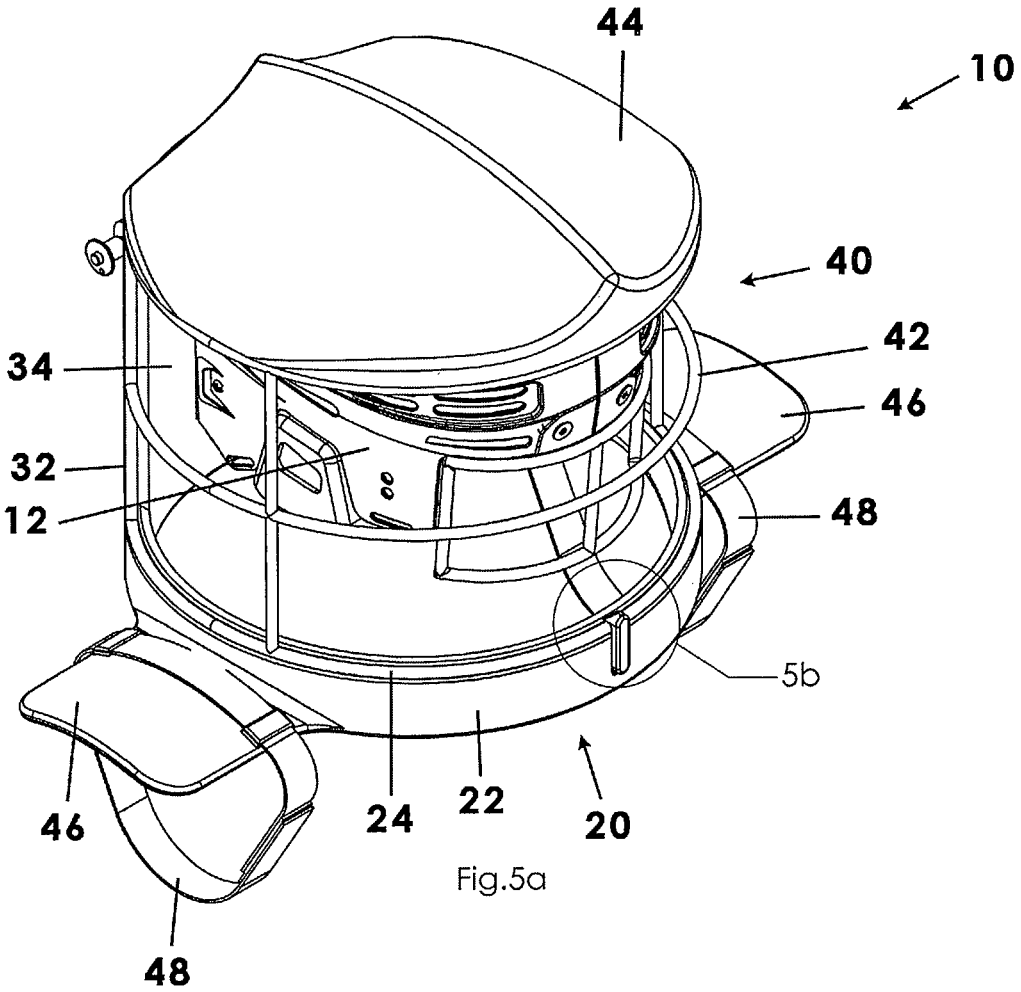
FIG. 5*a* is another perspective you of the auxiliary head protection apparatus as in FIG. 1*a;*
Figure 5B:
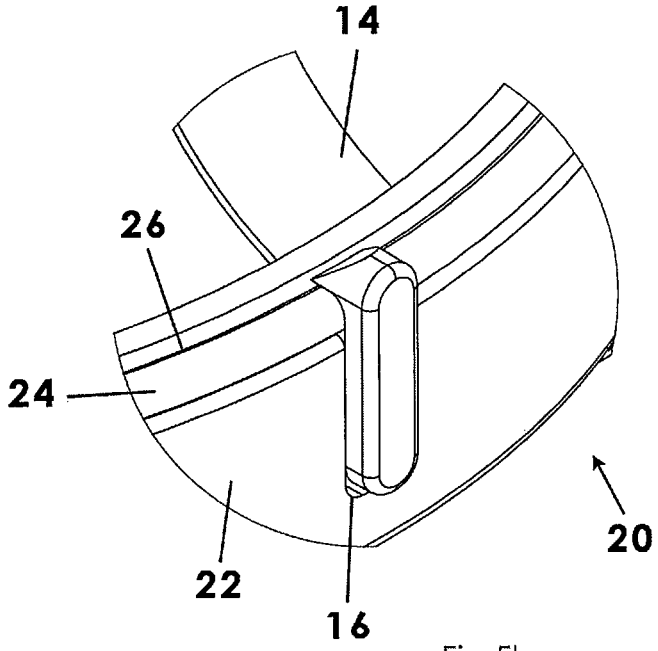
FIG. 5*b* is an isolated view on an enlarged scale taken from FIG. 5*a;*
Figure 6A:
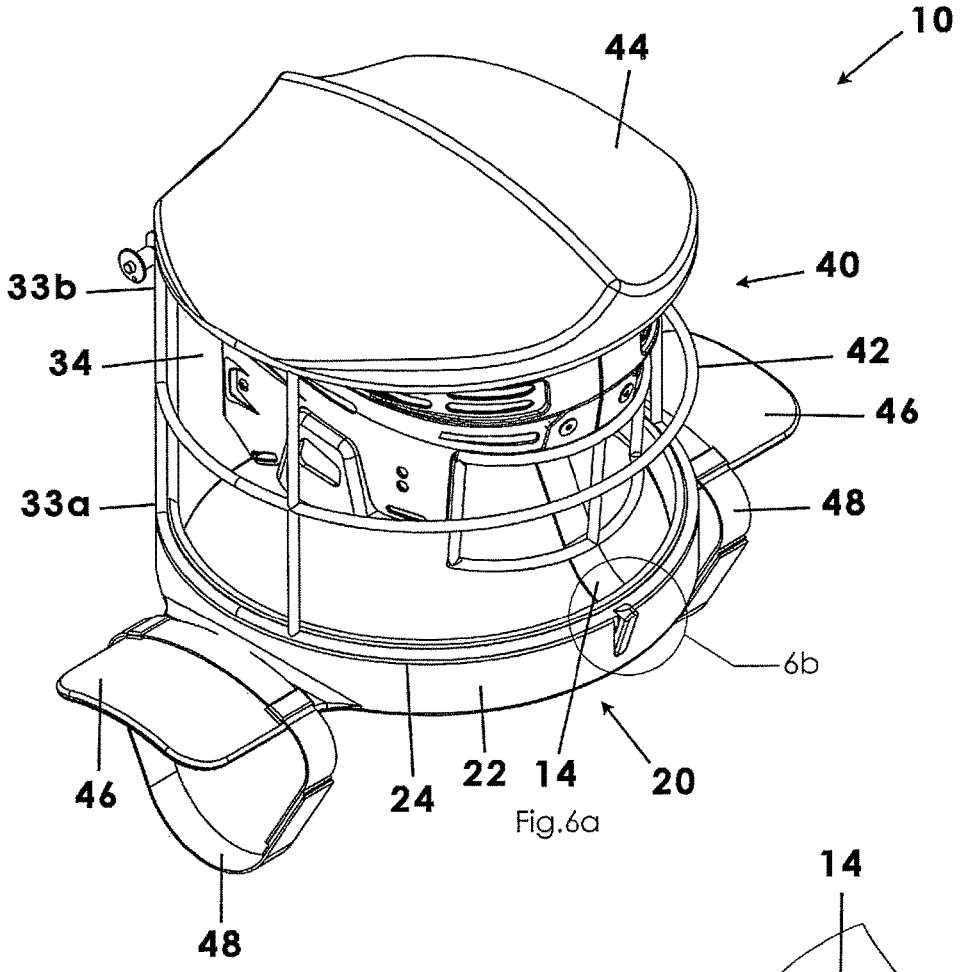
FIG. 6*a* is another perspective you of the auxiliary head protection apparatus as in FIG. 1*a;*
Figure 6B:
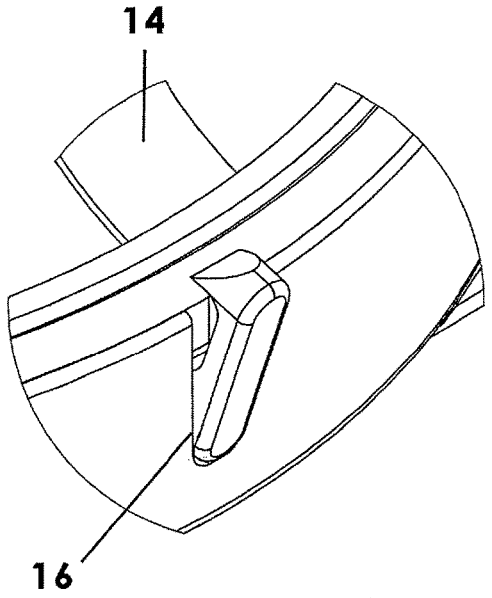
FIG. 6*b* is an isolated view on an enlarged scale taken from FIG. 6*a;*
Figure 7A:
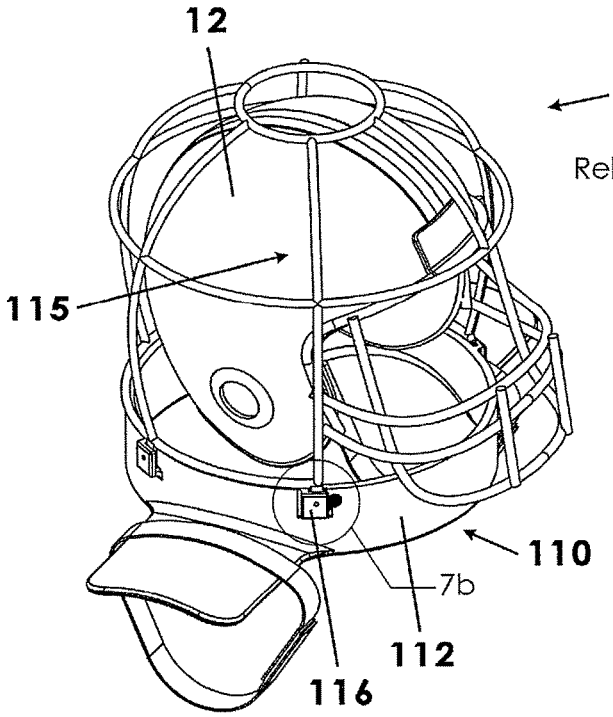
FIG. 7*a* is a perspective view of an auxiliary head protection apparatus according to another embodiment of the present invention, illustrated in a locked configuration.
Figure 7B:
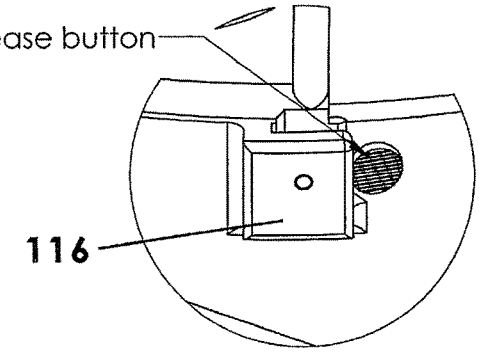
FIG. 7*b* is an isolated view on an enlarged scale taken from FIG. 7*a;*
Figure 7C:
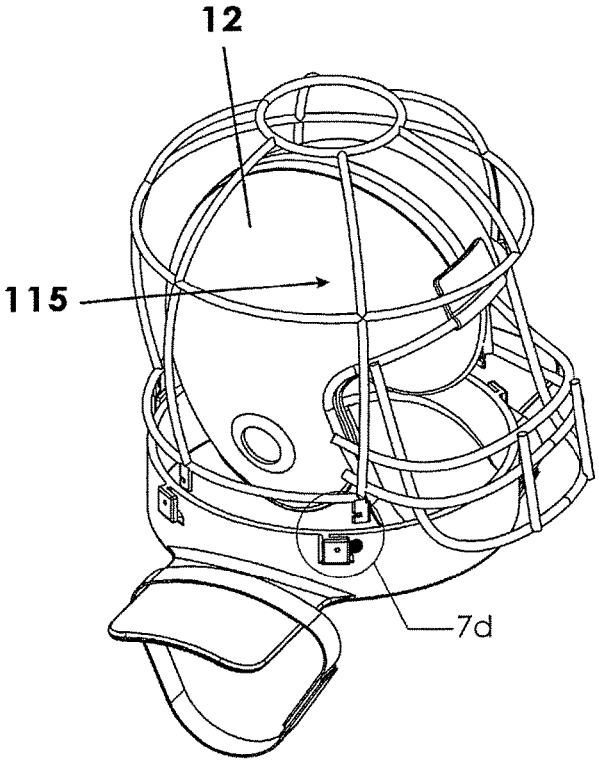
FIG. 7*c* is a perspective view of the auxiliary head protection apparatus as in FIG. 7*a;*
Figure 7D:
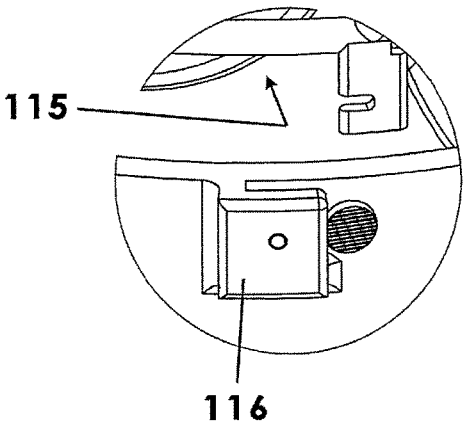
FIG. 7*d* is a perspective view of the auxiliary head protection apparatus as in FIG. 7*c*, illustrated in a released configuration.
Figure 8A:
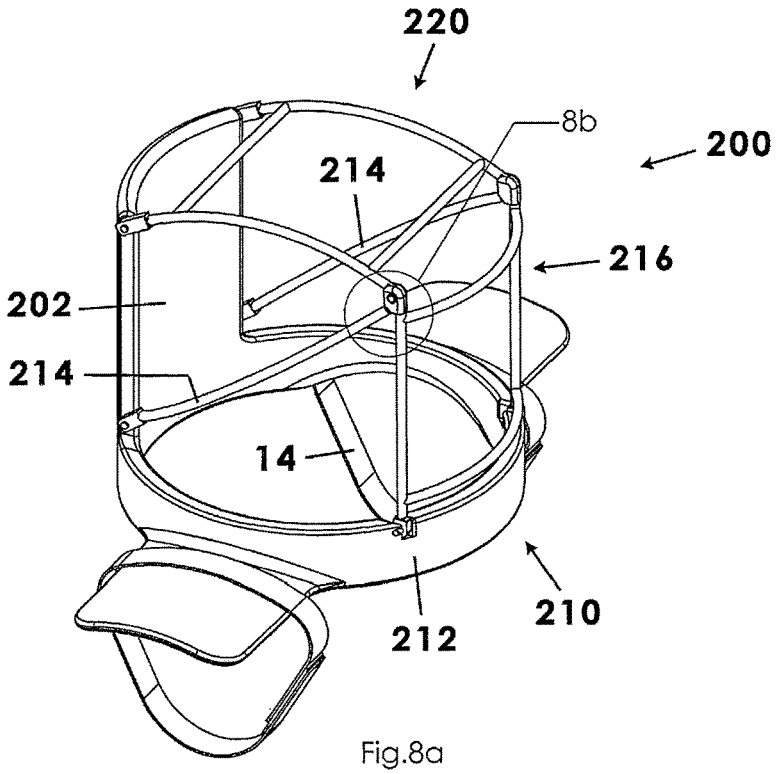
FIG. 8*a* is a perspective view of an auxiliary head protection apparatus according to another embodiment of the present invention, illustrated in a locked configuration.
Figure 8B:
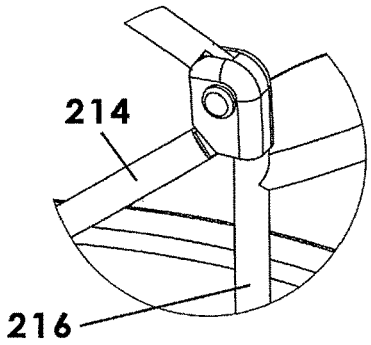
FIG. 8*b* is an isolated view on an enlarged scale taken from FIG. 8*a;*
Figure 8C:
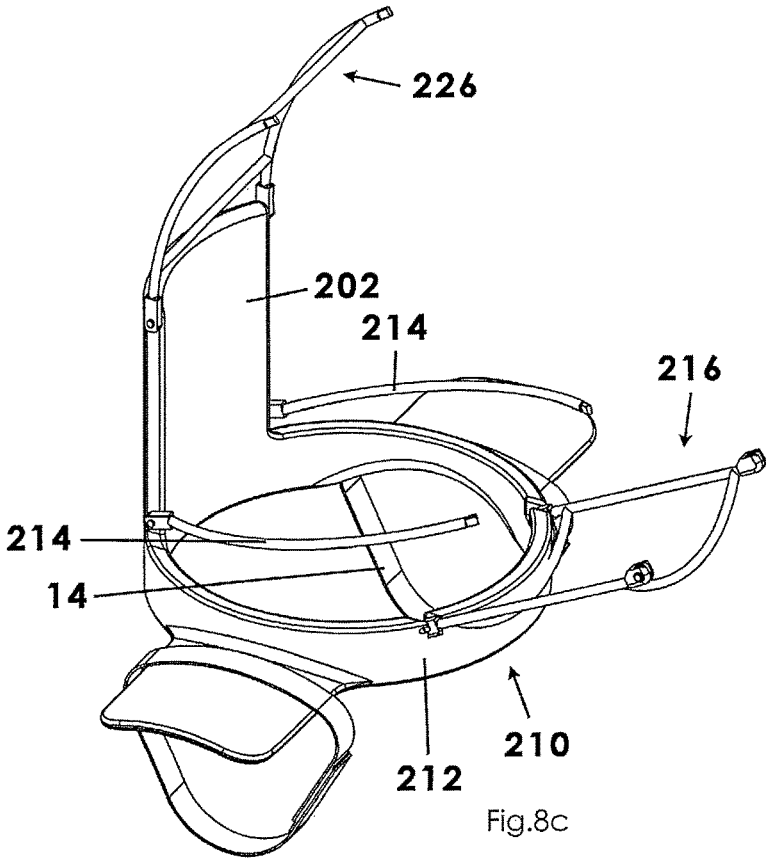
FIG. 8*c* is a perspective view of the auxiliary head protection apparatus as in FIG. 8*a*, illustrated in a released configuration.
Figure 9A:
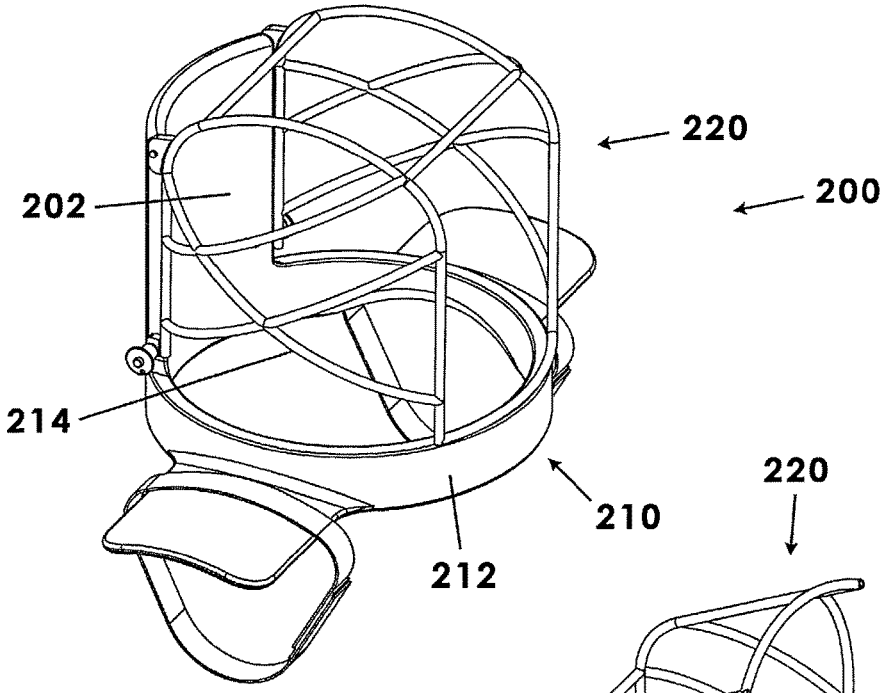
FIG. 9*a* is a perspective view of an auxiliary head protection apparatus according to another embodiment of the present invention, illustrated in a locked configuration.
Figure 9B:
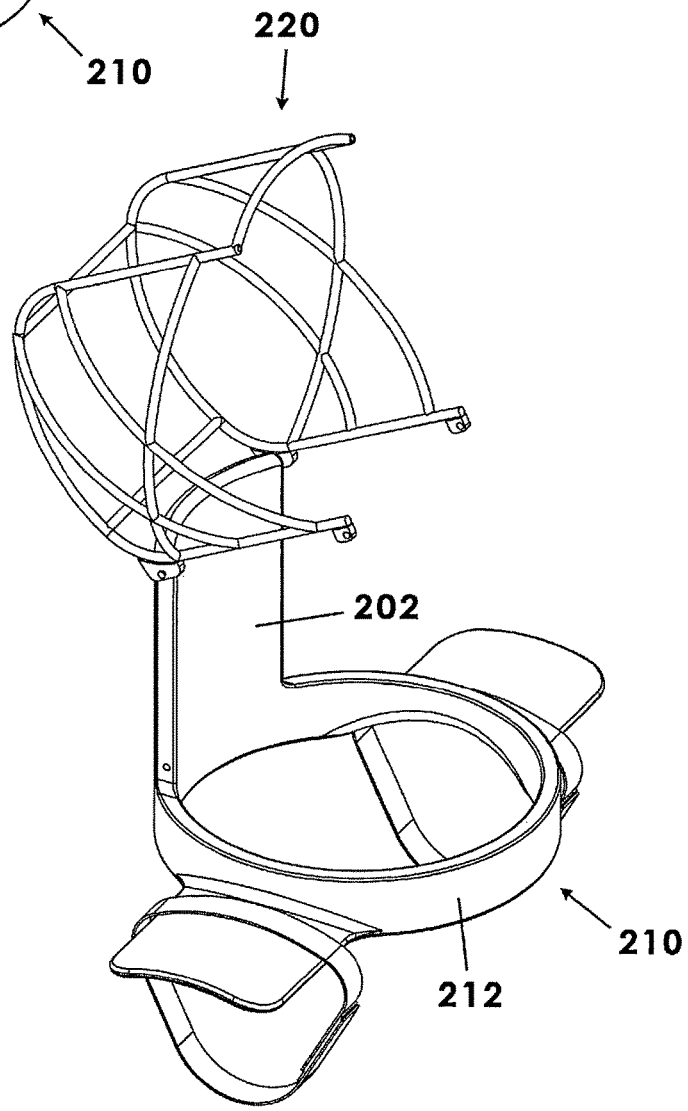
FIG. 9*b* is a perspective view of the auxiliary head protection apparatus as in FIG. 9*a*, illustrated in a released configuration.

In another aspect, a chinstrap 14 associated with a primary head protection device 12 may be releasably coupled to the rim 22. More particularly, a helmet strap receiver 16 may be mounted to an exterior surface of the rim 22, the receiver 16 being configured and operative to receive a fastener on a free end of the helmet strap 14 as shown in FIG. 3. It is understood that the receiver 16 may be a fastener that includes a snap, clasp, hook and loop fastener, button, or the like. In an embodiment, the receiver 16 is shown in a snap or friction fit arrangement (FIG. 5*b*).

An auxiliary head protection apparatus 100 according to another embodiment of the present invention is shown in FIGS. 7*a* to 7*d* and has a construction that is substantially similar to the embodiment first described above except as noted specifically below. The auxiliary head protection apparatus 100 also includes a base 110 having a rim 112 that defines a bottom opening and a face shield 115 that is coupled to the base 110, the face shield 115 having an open top. Notably, there is no top wall or lid in this embodiment. In this embodiment, however, the entire face shield 115 may be releasably coupled to the base with a pushbutton lug mechanism 116. With a push of a button, the entire face shield 115 may be quickly removed, giving access to the interior area, such as to the primary head protection device 12, e.g., a helmet. The lug mechanism 116 may be seen as a quick release fastener and is advantageous if fast access to the sports player's head or neck is needed quickly, such as to treat an injury.

Still another auxiliary head protection apparatus 200 according to another embodiment of the present invention is shown in FIGS. 8*a* to 9*b* and has a construction that is substantially similar to the embodiments described above except as noted specifically below. The auxiliary head protection apparatus 200 also includes a base 210 having a rim 212 that defines a bottom opening and includes a face shield 220 that may be pivotally coupled to a rear wall 202., However, the face shield includes only a pair of diagonally disposed side guard bars 214 and a front guard section 216 that is pivotally attached to the front section of the rim 212. As shown specifically in FIGS. 9*a* and 9*b*, the face shield 220 may be pivotally coupled to the rear wall 202 and also to the front guard section 216 with a latch.

The invention claimed is:

1. An auxiliary head protection apparatus configured to cover a primary head protection device worn on the head of a sports player and of a type which has a chin strap, said auxiliary head protection apparatus, comprising:

a base including a rim that defines an open bottom for wear on the head of the sports player;

a framework extending upwardly from predetermined sections along said rim, said framework including a rear wall having a lower edge coupled to the rim and extending upwardly to an upper edge;

a face shield comprising an array of bars and coupled to said upper ends edge of said rear wall of said framework and that is pivotally movable about an axis defined by said upper edge between a closed configuration in which a lower edge thereof bears against said rim such that said array of bars blocks access to an interior area and an open configuration pivoted about said axis such that said array of bars allows access to said interior area;

wherein said face shield includes a top wall mounted atop said face shield and having a front edge and a rear edge opposite said front edge, said top wall having a ridged configuration extending away from said top wall along an imaginary longitudinal axis that extends between said front and rear edges for redirecting impact forces encountered by said top wall;

wherein said framework includes the rear wall having an upward extension extending upwardly therefrom, said rear wall defining an imaginary center vertical axis and defining an annular configuration curved around said center vertical axis throughout the upward extension of the rear wall and having a solid construction so as to block impact forces encountered from a rear direction.

2. The auxiliary head protection apparatus as in claim 1, further comprising a pair of mounting flanges coupled to opposed outer surfaces of said base and extending outwardly along a generally horizontal axis.

3. The auxiliary head protection apparatus as in claim 2, wherein said pair of mounting flanges each includes a strap configured for attachment to auxiliary sports gear.

4. The auxiliary head protection apparatus as in claim 1, wherein said face shield is configured to cover said primary head protection device is when said face shield in the closed configuration.

5. The auxiliary head protection apparatus as in claim 1, wherein said array of bars includes at least a pair of vertical bars spaced apart from one another and at least a pair of horizontal bars spaced apart from one another and extending between said at 4 least a pair of vertical bars, respectively.

6. The auxiliary head protection apparatus as in claim 5, wherein said rim defines a groove configured to receive a lower bar of said at least a pair of horizontal bars associated with said array of bars when said face shield is in the closed configuration.

7. The auxiliary head protection apparatus as in claim 1, further comprising a helmet strap receiver mounted to an exterior surface of said rim, said helmet strap receiver being configured to selectively mate with an end of a chinstrap associated with the primary head protection device.

8. The auxiliary head protection apparatus as in claim 7, wherein said helmet strap receiver is a quick connect fastener.

9. An auxiliary head protection apparatus configured to cover a helmet, wherein the helmet is configured to be worn on the head of a football player and of a type which has a facemask and chin strap, said auxiliary head protection apparatus, comprising:

a base including a rim that defines an open bottom for wear on the head of the football player;

a framework extending upwardly from predetermined sections along said rim, said framework including a rear wall having a lower edge coupled to the rim and extending upwardly to an upper edge, said base and said framework, together, defining an interior area;

a face shield comprising an array of bars being coupled to said upper edge of said rear wall of said framework and that is pivotally movable about an axis defined by said upper edge between a closed configuration in which a lower edge thereof bears against said rim such that said array of bars blocks access to said interior area and an open configuration pivoted about said axis such that said array of bars allows access to said interior area;

wherein said face shield includes a top wall mounted atop said face shield and having a front edge and a rear edge opposite said front edge, said top wall having a ridged configuration extending away from said top wall along an imaginary longitudinal axis that extends between said front and rear edges for redirecting impact forces encountered by said top wall;

wherein said framework includes the rear wall having an upward extension extending upwardly therefrom, said rear wall defining an imaginary center vertical axis and defining an annular configuration curved around said center vertical axis throughout the upward extension of the rear wall and having a solid construction so as to block impact forces encountered from a rear direction.

10. The auxiliary head protection apparatus as in claim 9, further comprising a pair of mounting flanges coupled to opposed outer surfaces of said base and extending outwardly in opposing directions along a generally horizontal axis.

11. The auxiliary head protection apparatus as in claim 10, wherein said pair of mounting flanges each includes a strap configured for attachment to shoulder pads associated with the football player.

12. The auxiliary head protection apparatus as in claim 9, wherein said face shield is configured to cover the helmet when said face shield in the closed configuration.

13. The auxiliary head protection apparatus as in claim 9, wherein said array of bars includes at least a pair of vertical bars spaced apart from one another and at least a pair of horizontal bars spaced apart from one another and extending between said at least a pair of vertical bars, respectively.

14. The auxiliary head protection apparatus as in claim 13, wherein said rim defines a groove configured to receive a lower bar of said at least a pair of horizontal bars associated with said array of bars when said face shield is in the closed configuration.

15. The auxiliary head protection apparatus as in claim 9, further comprising a helmet strap receiver mounted to an exterior surface of said rim, said helmet strap receiver being configured to selectively mate with an end of a chinstrap associated with the primary head protection device.

16. The auxiliary head protection apparatus as in claim 15, wherein said helmet strap receiver is a quick connect fastener.

17. An auxiliary head protection apparatus configured to cover a helmet, wherein the helmet is configured to be worn on the head of a football player and of a type which has a facemask and chin strap, said auxiliary head protection apparatus consisting of:

a base including a rim that defines an open bottom for wear on the head of the football player;

a framework extending upwardly from predetermined sections along said rim, said framework including a rear wall having a lower edge coupled to the rim and extending upwardly to an upper edge, said base and said framework, together, defining an interior area;

a face shield comprising an array of bars and being coupled to upper ends of said framework and that is pivotally movable about an axis defined by said upper edge between a closed configuration in which a lower edge thereof bears against said rim such that said array of bars blocks access to said interior area and an open configuration pivoted about said axis such that said array of bars allows access to said interior area;

wherein said face shield includes a top wall mounted atop said face shield and having a front edge and a rear edge opposite said front edge, said top wall having a ridged configuration extending away from said top wall along an imaginary longitudinal axis that extends between said front and rear edges for redirecting impact forces encountered by said top wall;

wherein said framework includes the rear wall having an upward extension extending upwardly therefrom, said rear wall defining an imaginary center vertical axis and defining an annular configuration curved around said center vertical axis throughout the upward extension of the rear wall and having a solid construction so as to block impact forces encountered from a rear direction.

* * * * *